United States Patent [19]

Childress

[11] Patent Number: 4,872,781

[45] Date of Patent: Oct. 10, 1989

[54] OPEN TOP FLOATABLE BARGE REPAIR BOX WITH BARGE TO BOX SEALING SYSTEM

[76] Inventor: Joseph B. Childress, 6630 River Pl., Gulf Shores, Ala. 36542

[21] Appl. No.: 273,451

[22] Filed: Nov. 18, 1988

[51] Int. Cl.[4] ..... E02D 23/02; B63C 11/00

[52] U.S. Cl. ..... 405/12; 405/11; 405/194

[58] Field of Search ..... 405/44, 12, 188, 189, 405/190, 191; 114/227, 45, 322

[56] References Cited

U.S. PATENT DOCUMENTS

| | | | |
|---|---|---|---|
| 395,265 | 12/1888 | Clarke | 405/12 |
| 538,780 | 5/1895 | Holford . | |
| 689,979 | 12/1901 | Mason . | |
| 783,276 | 2/1905 | Hughes | 405/12 |
| 932,719 | 8/1909 | Reinhardt . | |
| 2,360,690 | 10/1944 | Koulichkov | 405/12 |
| 3,638,437 | 2/1972 | Fukuda . | |
| 3,768,265 | 10/1973 | Brouillette | 405/12 |
| 3,857,249 | 12/1974 | Kelly . | |
| 4,175,510 | 11/1979 | Devine | 405/12 X |
| 4,292,914 | 10/1981 | Jonsson . | |
| 4,362,437 | 12/1982 | Leary | 405/188 |
| 4,615,641 | 10/1986 | Novay | 405/12 |
| 4,626,128 | 12/1986 | Devine | 405/188 X |
| 4,695,198 | 9/1987 | Goodacre et al. | 405/224 |

FOREIGN PATENT DOCUMENTS 921958 of 0000 U.S.S.R. .

1485501 of 0000 United Kingdom .

*Primary Examiner*—Dennis L. Taylor

*Attorney, Agent, or Firm*—A. Robert Theibault

[57] ABSTRACT

The present disclosure is directed to a watertight floodable barge repair box of generally L-shape, viewed from its end, having a leg and a foot. The leg has an open front and the foot has an open top so that the box may be placed against the side of the barge and the foot beneath its bottom. A flexible waterproof membrane strip has one edge secured to a flat bar anchoring plate welded to the repair box adjacent its leg and foot openings upset at an angle thereto. A backing of flat rubber conveyor belt is bolted between the waterproof membrane and flat anchoring plate. The waterproof membrane is of a width to overlap the connection between the barge hull and barge repair box when the repair box is in place against the barge in a flooded down condition in a body of water. Cable harness or other suitable lines or chains are used to maintain the barge in place against the repair box. A tie down system of lines are connected between the free edge of the waterproof membrane and the work box is employed to keep the free edge of the membrane from becoming engaged between the barge and work box during securing of the barge to the box. The free end of the waterproof membrane is released after the work box and barge have been secured together permitting it to float up and form a watertight seal between the barge and box prior to pumping water from the repair box.

6 Claims, 3 Drawing Sheets

OPEN TOP FLOATABLE BARGE REPAIR BOX WITH BARGE TO BOX SEALING SYSTEM

TECHNICAL FIELD

My invention relates to a portable land or water transportable work box for effecting below the water-line repairs to barges wherein the work box does not have ballast tanks and wherein the entire work box is flooded down for positioning in the area of the barge hull to be repaired. A waterproof membrane one edge of which is secured to the box about a box open area where repairs are to be effected and the other edge is held down by tie downs until the barge and work box are tied together after which the hold downs connected to the watertight membrane are released so it may float up against the barge hull and as water is pumped out of the box a watertight membrane connected to the work box and barge hull will result in a dry work area in the work box in which to effect barge repairs.

When working around a barge, particularly a barge damaged below the waterline inorder to avoid the expense of having to drydock the barge a work boat having a crane is employed for moving the work box into and out of position as well as having pumps for pumping out the flooded down work box when it is properly secured to the barge and ready to be loaded with workmen and equipment.

BACKGROUND PRIOR ART

The U.S. Pat. No. 4,615,641 is the most pertinent patent known to me at the filing of this application but it lacks the structure and mode of operation set out in my claims.

There are numerous cofferdam patent structures in the prior art for effecting vessel repairs below the water-line which does not require drydocking of the damaged vessel such as the following:

| | |
|---|---|
| 4,615,641 | 932,719 |
| 3,638,437 | 538,780 |
| 3,768,265 | 689,979 |
| 4,292,914 | 1,485,501 (British) |
| 2,360,690 | 921,958 (USSR) |
| 3,857,249 | 4,626,128 |

The work box of my invention has no ballast tanks as shown in U.S. Pat. No. 4,615,641 to Novay. Novay does not have a waterproof membrane with tie downs which are only released to permit the membrane to rise and effect a watertight seal between the barge and work box when the water is pumped out of the barge repair box.

BACKGROUND OF THE INVENTION

The present invention is directed to a cofferdam - like open top box of L-shaped construction having the open top at the top of the leg of the L-shape so that welding and cutting may take place below the water-line of the barge to be repaired without imparing the breathing of workmen in the box engaged in cutting or welding operations employing gases giving off toxic fumes dangerous to their health working in a constricted environment. The barge repair box is of the rigid transportable type which may be trailered to the barge location where the below the water-line repair is to be made without the necessity of dry docking the barge.

The barge repair box of my invention may be floated down a body of water or trailered to the barge to be repaired such as welding a plate over a gash in the barge hull below the waterline. The box is then flooded down with water from the body of water in which it was transported and the L-shape is urged into contact with the side wall of the barge so that the foot of the L-shape will pass beneath the juncture of the barge side wall and its bottom. The side of the leg of the L-shape to be urged against the barge side-wall is open to provide work access to the damaged portion of the barge wall. A water tight seal between the barge and the work box is provided so that the water in the flooded box may be pumped from the box to impart bouyancy to the box and to raise the damaged area of the barge for repair. A waterproof membrane of such material as closed cell rubber, neoprene or other flexible waterproof material is secured to bar stock welded to the box wall adjacent the opening in the side-wall of the box. The waterproof membrane is of a wide strip having one edge bolted to the bar stock and backed by rubber conveyor belting. The free edge of the waterproof membrane has string tie downs to hold the membrane from being pinched between the work box and barge until the work box has been tightly engaged with the barge side-wall and bottom. When this is accomplished the string tie downs are released and the free ends of the membrane will float up and engage the barge. When the work box is pumped out the membrane will make a watertight seal so that workmen and equipment can be loaded through the open top of the box down ladders to effect barge repairs accessible through the open wall of the work box. Cables and slings maintain the work box against the barge and the rubber conveyor belt backed waterproof membrane maintains the watertight seal between the work box and barge.

BEST MODE FOR CARRYING OUT THE INVENTION

Figure 1:
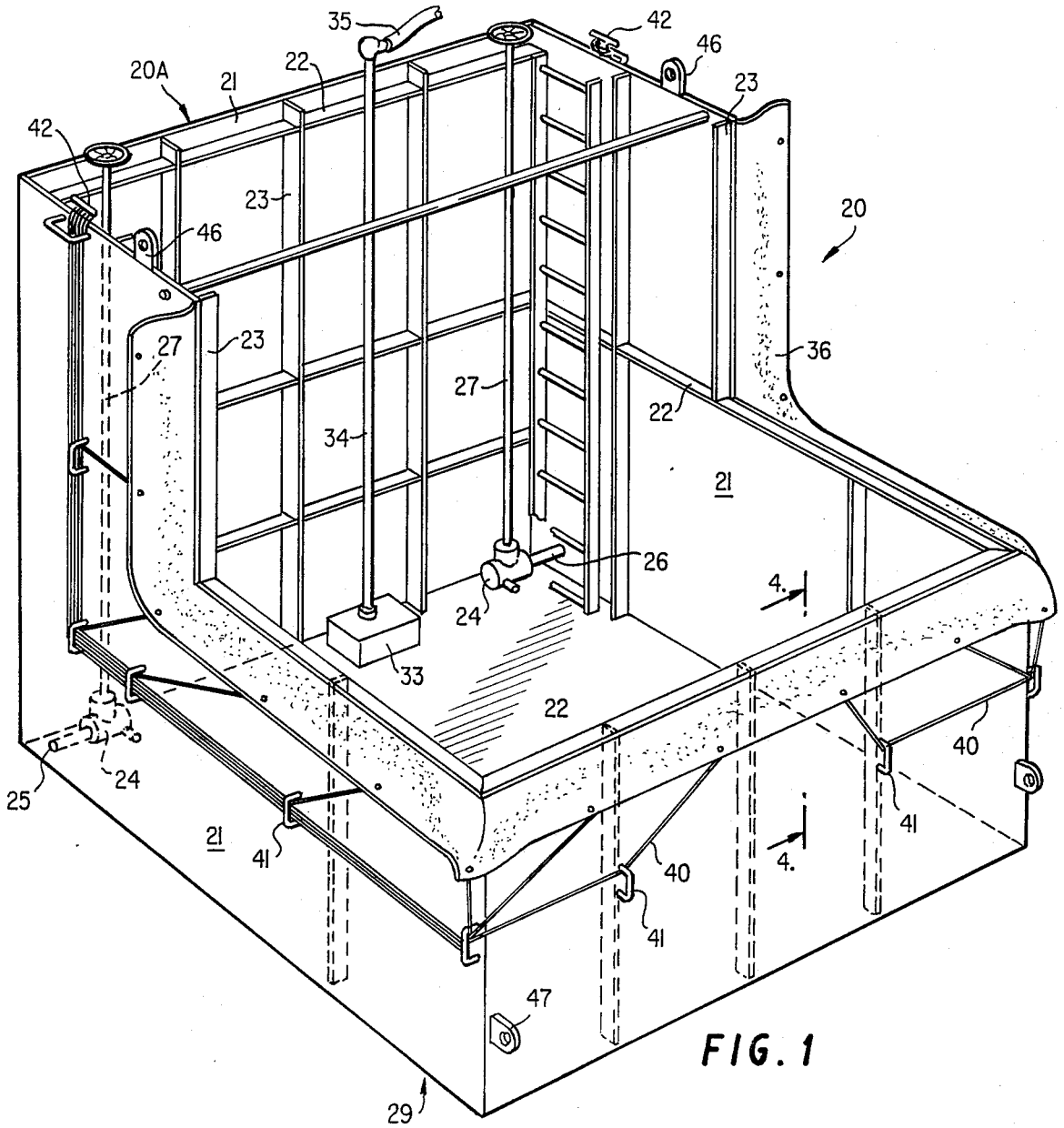
FIG. 1 is a perspective view of the barge repair box of the present invention showing box to barge waterproof membrane seal in its hold down condition during attachment of the box to a barge to be repaired.
Figure 2:
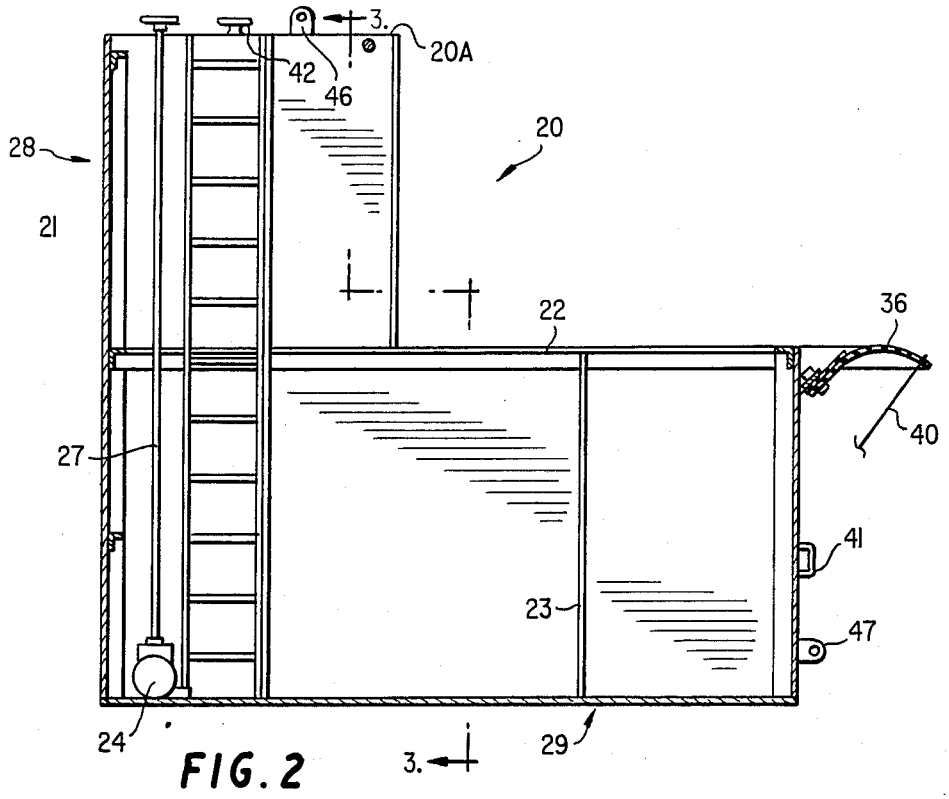
FIG. 2 is a vertical transverse sectional view through the barge repair box of FIG. 1.
Figure 3:
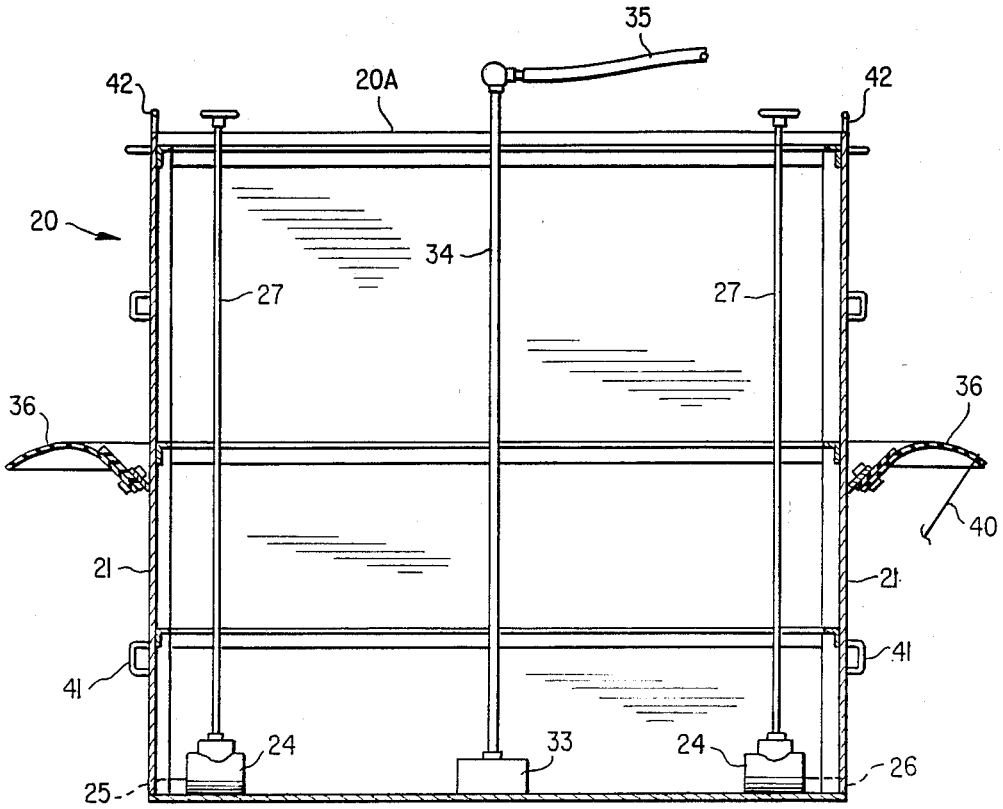
FIG. 3 is a vertical longitudinal sectional view taken on the lines 3—3 in FIG. 2.

Referring now to FIGS. 1–3, the barge repair box 20 is of all steel plate welded construction 3/16" plates 21 reinforced with angle iron 22, flat bars 23 and two three inch gate valves 24 connected to galvanized external nipples 25, 26 for flooding the repair box. The gate valves 24 are opened and closed with reach rods 27. The box 20 is of L-shaped construction having a vertical leg 28 and a foot 29. The leg 28 is open across its front and the foot 29 is open across its top for access to the side 30 and bottom 31 of a barge 32 to be repaired. The interior of the box 20 has a sump box 33 connected to a pipe 34 for connection to a suction hose 35 from a pump (not shown) on the box 20, barge 32 or work boat.

A waterproof membrane 36 haing a rigid conveyor belt backing 37 is connected by bolts 38 to flat plate stock 39 welded to the work box exterior about the open front of the leg 28 and the open top of the foot 29.

Figure 4:
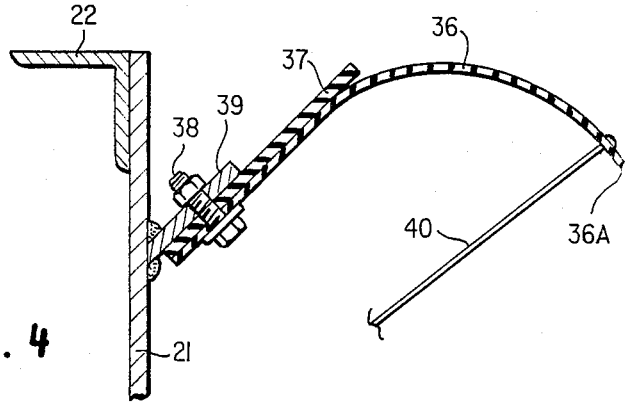
FIG. 4 is an enlarged fragmentary sectional view of the waterproof membrane seal mounting on the barge repair box of FIG. 1.

The waterproof membrane 36 may be of ½"×12" rubber strip, one edge of which is bolted to the flat plate stock 39, which has been welded to the work box 20 as best seen in FIG. 4. The free edge 36A of the membrane is held down during attachment of the work box 20 to a barge 32 to be repaired to prevent it from being pinched between the box 20 and the barge 32 to prohibit an effective watertight seal between the box 20 and barge 32. A system of tie downs 40 of nylon line by way of example ¼" parachute line, one end of which is secured to the free edge 36A of the membrane and the line 40 is passed through eye rings 41 weld tacked to the steel plate of the box 20 and lead to an attaching bracket 42 where it is secured until the box is set in place against the side and bottom of the barge 32 to be repaired, by a crane on the work boat, after which the lines 40 are released from bracket 42 and the unattached edge 36A of the membrane 36 will float up forming a watertight seal between the barge 32 and work box 20 as the flood down water which entered the work box 20 through gate valves 24, is pumped out of the box 20 after closing the valves 24.

When the work box 20 has been pumped dry the work ladders are placed in the repair box through its top opening 20A, workmen and welding and cutting equipment enter the box and the repairs now begin from the outside of the barge 32.

The repair box 20 is fitted in place against the side and bottom of the barge 32 by using a sling 43 connected to the crane of the work boat which will position the flooded down work box 20 in the area of repair to be effected.

Figure 5:
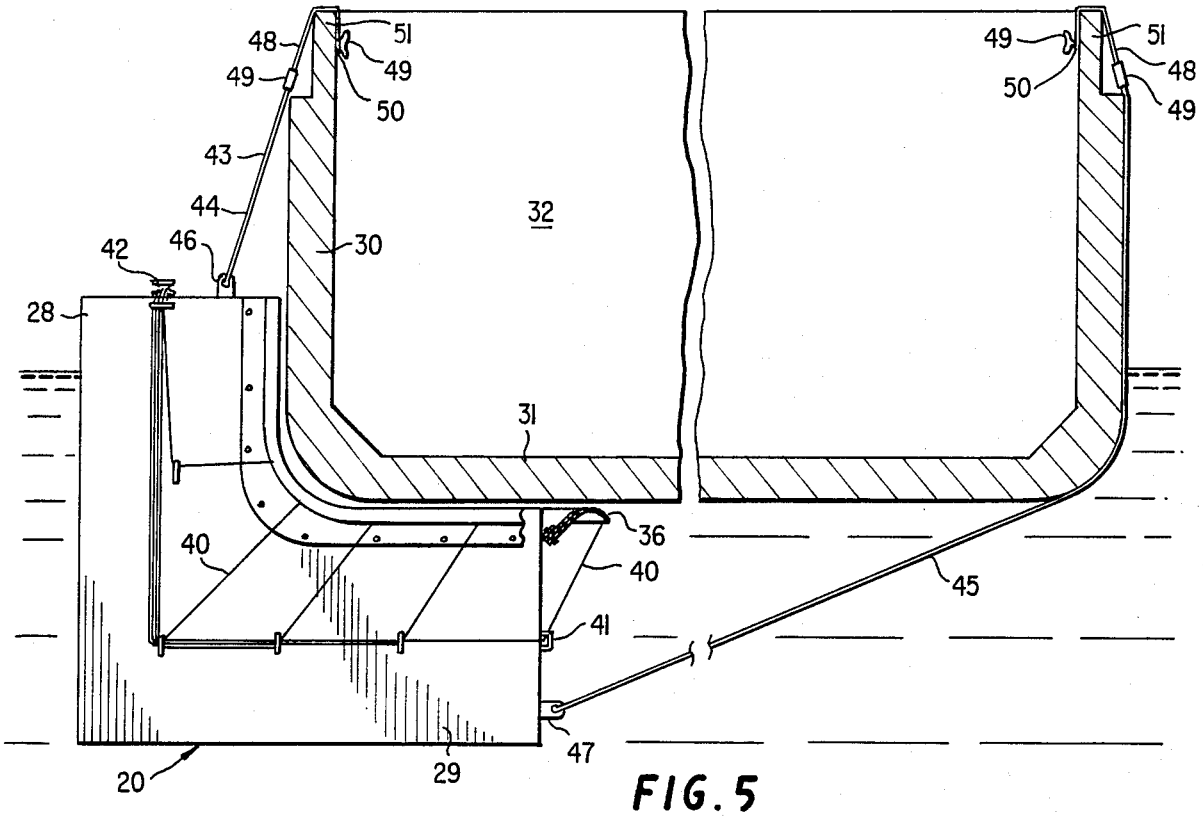
FIG. 5 is a transverse sectional view through a barge to be repaired having a barge repair box being attached thereto with the underwater waterproof membrane seal held out of engagement with the barge.
Figure 6:
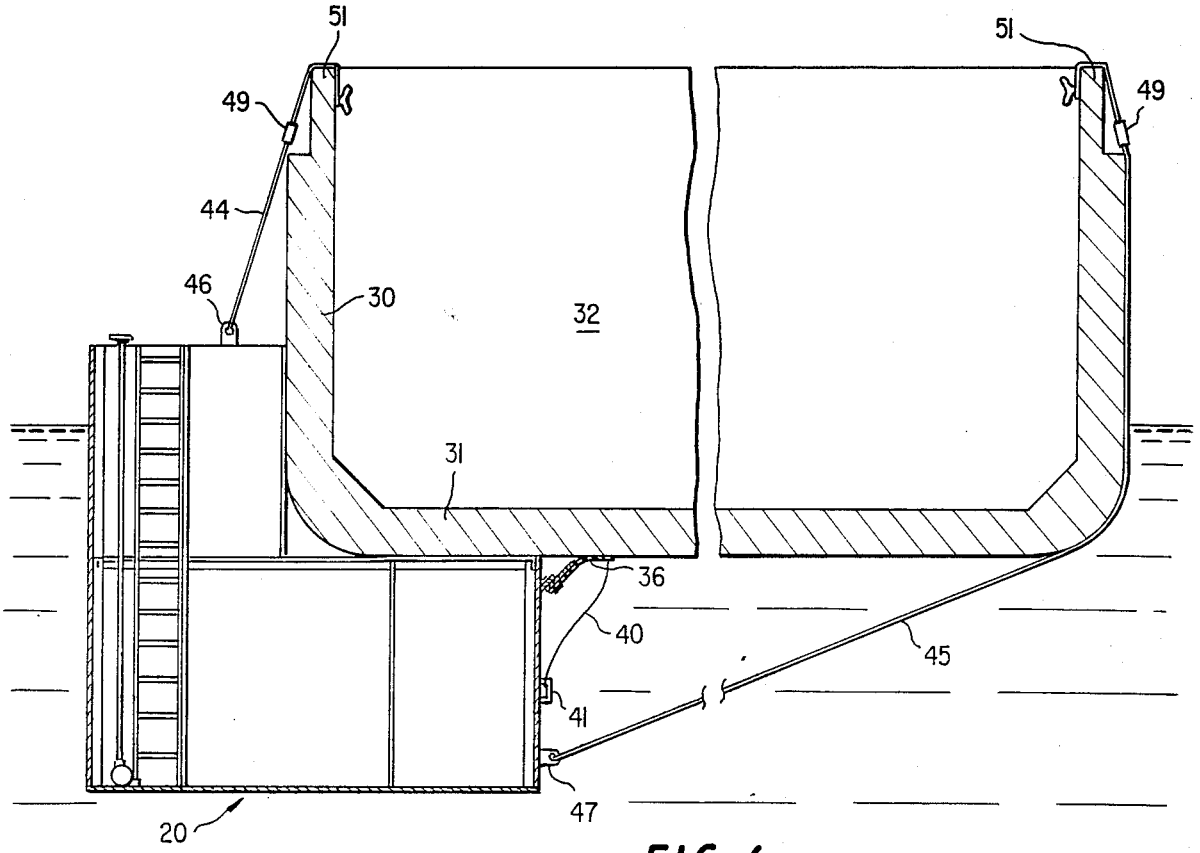
FIG. 6 is a view similar to FIG. 5 with the repair box attached firmly in place against the barge and the underwater seal released to establish a watertight seal between the barge and barge repair box.

The L-shaped repair box 20 as best seen in FIG. 5 is equiped with harnesses 44, 45 secured to the work box at pad eyes 46, 47 at the free end of the foot 29 and at the top of the leg 28. Each harness is secured to a chain or cable 48 for connection through a ratchet take up device 49 connected to a hook 50 which engages the barge hatch combing 51 to anchor the take up device so that the work box 20 may be rigidly secured to the barge 32 in a watertight fashion so repairs may proceed.

The harnesses 44, 45 may be used by a crane on the work boat to position the flooded down work box 20 against and beneath the barge prior to pumping the repair box dry after effecting the watertight seal between barge and repair box.

What I claim is:

1. A watertight floodable barge repair box comprising an L-shaped athwartship construction having a vertical leg and horizontal foot, the top of said vertical leg being open, an open front wall on said leg and an open top wall on said foot, a flexible waterproof unitary contiguous flexible membrane strip one edge of which is secured to said box about the open front wall on said leg and the open top wall of said foot and said strip being of a width to overlap the connection between the barge hull and barge repair box when said barge is in place in a body of water between said leg and said foot, cable attaching means connected between said barge and said barge repair box to maintain said barge in place against said repair box, and tethering means connected between the free edge of said contiguous flexible waterproof membrane and said work box to keep the free edge of said membrane from being engaged between said barge and work box during securing of the barge to the work box which is releasable to permit the waterproof membrane to form a watertight seal between the barge and work box when the work box is secured tightly against the barge prior to pumping the water from the work box.

2. A watertight barge repair box as claimed in claim 1, further comprising a waterproof membrane flat anchoring plate welded to said work box about the front wall on the leg of said box and about the open top wall on said foot, a rubber conveyor belt backing strip between said membrane strip and said flat bar anchoring plate to which said backing strip and membrane are bolted in watertight engagement.

3. An apparatus as claimed in claim 2, wherein said waterproof membrane strip is of a width in excess of the contact area between the work box and the barge to assure a watertight seal between said barge and work box when the free edge of the waterproof membrane is released with the barge secured in place to said barge repair box so that the free edge of the membrane will float toward the barge effecting a watertight seal between said barge and work box.

4. An apparatus as claimed in claim 3, wherein said waterproof membrane strip is of a closed cell sheet rubber stock at least six inches in width.

5. An apparatus as claimed in claim 3, wherein said waterproof membrane is of a sheet of flexible rubber stock backed by a thick strip of heavy rubber conveyor belting to prevent tearing of said waterproof membrane.

6. An apparatus as claimed in claim 5, further comprising magnet means placed on the side of said contiguous homogeneous membrane away from the barge to maintain the membrane against the barge to assure watertight contact between said membrane, barge and work box.

* * * * *